US005904344A

United States Patent [19]

Pope et al.

[11] Patent Number: 5,904,344

[45] Date of Patent: May 18, 1999

[54] FLOOR LOCKING LINKAGE FOR COLLAPSIBLE PLAYPEN

[75] Inventors: Lenard E. Pope, Cleveland; Robert John Warner, Jr., Stow, both of Ohio

[73] Assignee: Graco Children's Products Inc., Elverson, Pa.

[21] Appl. No.: 08/984,980

[22] Filed: Dec. 4, 1997

[51] Int. Cl.[6] ..... E04H 17/16

[52] U.S. Cl. ..... 256/25; 256/26; 403/102; 5/99.1

[58] Field of Search ..... 256/25, 26; 5/99.1, 5/98.1, 93.2, 93.1; 403/102, 101, 100, 119; 248/525

[56] References Cited

U.S. PATENT DOCUMENTS

| | | | |
|---|---|---|---|
| 2,014,896 | 9/1935 | Hollander | 248/525 |
| 2,683,321 | 7/1954 | Faber | 43/12 |
| 4,929,113 | 5/1990 | Sheu | 403/157 |
| 5,039,118 | 8/1991 | Huang | 280/47.371 |
| 5,056,805 | 10/1991 | Wang | 280/47.36 |
| 5,058,283 | 10/1991 | Wise et al. | 33/371 |
| 5,062,179 | 11/1991 | Huang | 16/111 R |
| 5,123,768 | 6/1992 | Franklin | 403/96 |
| 5,377,368 | 1/1995 | Cheng | 5/99.1 |
| 5,381,570 | 1/1995 | Cheng | 5/99.1 |
| 5,542,134 | 8/1996 | Wang | 5/99.1 |
| 5,542,151 | 8/1996 | Stranski et al. | 16/236 |
| 5,664,267 | 9/1997 | Cheng | 5/99.1 |
| 5,699,997 | 12/1997 | Huang | 256/26 |
| 5,711,040 | 1/1998 | Huang | 5/99.1 |

*Primary Examiner*—Brian K. Green
*Assistant Examiner*—Daniel Gambrill
*Attorney, Agent, or Firm*—Knobbe, Martens, Olson & Bear, LLP

[57] ABSTRACT

A floor lock assembly for a playpen prevents collapse of the apparatus when it is occupied by a child, whereby a potential safety problem is obviated. In a typical playpen collapsible frame, a lower frame assembly is comprised of a pair of parallel connecting rod units pivotally joined to a pair of crossing rod assemblies. The floor lock assembly extends between the pivoting intersections of the crossing rod units, and includes a pair of rigid linking members extending in opposed relationship from a lock bracket, each linking member pivotally joined to one of the pivoting intersections of the crossing rod units. Each linking member is limited in angular range in its pivoting relationship to the lock bracket, whereby the lock bracket may be supported by the linking members (when the lower frame is in a deployed configuration) in a generally horizontal overcenter disposition beneath a medial portion of the floor panel of the playpen. To collapse the frame, the two pivoting intersections of the crossing rod units must move towards each other as the lock bracket moves upwardly past the overcenter position, and thus the floor panel must moved upwardly with the lock bracket. The weight of a child on the floor panel blocks upward movement of the floor panel, thus also blocking collapse of the frame structure. In the absence of the weight of the child, the lock bracket may be urged upwardly with slight pressure, and the frame collapses without hindrance.

9 Claims, 2 Drawing Sheets

FLOOR LOCKING LINKAGE FOR COLLAPSIBLE PLAYPEN

BACKGROUND OF THE INVENTION

This invention generally relates to collapsible play yard or play pen apparatus, and more particularly to an improved frame construction for such apparatus. An exemplary apparatus in the prior art is described in U.S. Pat. No. 5,381,570 to Cheng, which is incorporated herein by reference in its entirety.

Any apparatus intended for use with babies and children must be designed with safety as the utmost consideration. The typical collapsible playpen is generally comprised of a hinged frame structure adapted to support a foldable enclosure, the frame and enclosure undergoing complementary movements to transform from an expanded, erected disposition in which the apparatus supports a baby or toddler, to a knock-down disposition in which the apparatus occupies a minimum volume for optimum storage and transport.

One potential failure mode of such apparatus occurs when the frame folds up accidentally with a baby or toddler supported within the apparatus. This action may entrap and injure the limbs or neck of the occupant. Accordingly, all reasonable measures must be taken to prevent such occurrences. One device known in the prior art that addresses this problem, described in U.S. Pat. No. 5,542,151, protects the folding joints of the upper frame members from accidental release and collapse due to incidental contact or manipulation by the occupant of the playpen.

However, if the improved folding frame structure is compromised in some unforeseen manner, there is no further protection from accidental collapse of the apparatus. Thus it would be desirable for such prior art apparatus to include a failsafe device that prevents accidental collapse of the apparatus when it is occupied by a baby, toddler or child, without regard to the cause of the accident, whether known or unforeseen.

SUMMARY OF THE INVENTION

The invention generally comprises an improved collapsible frame structure for a playpen or play yard apparatus. A significant feature of the invention is that it prevents collapse of the apparatus when it is occupied by a baby or infant, whereby a potential safety problem is obviated.

A typical playpen collapsible frame structure generally includes a lower frame assembly comprised of a pair of parallel connecting rod units pivotally joined to a pair of crossing rod assemblies, as described in the Cheng patent. In addition, a pair of movable bases extend from the connecting rod units to broaden support for the playpen floor, and a pair of locating bases support the pivoting intersections of the crossing rods. During collapse of the lower frame assembly, the pivoting intersections move toward each other as the crossing rods pivot about their connections to the connecting rods.

In accordance with the present invention, the lower frame structure is provided with a floor lock assembly extending between the pivoting intersections of the crossing rod units. The floor lock assembly includes a pair of rigid linking members extending in opposed relationship from a lock bracket, each linking member pivotally joined to one of the pivoting intersections of the crossing rod units. Each linking member is joined to the lock bracket in a pivoting relationship that is limited in angular range, whereby the lock bracket may be supported by the linking members (when the lower frame is in a deployed configuration) in a generally horizontal disposition beneath a medial portion of the floor panel of the playpen.

In order for the playpen frame assembly to be collapsed, the two pivoting intersections of the crossing rod units must move towards each other, as noted above. This action can occur only if the lock bracket moves upwardly and the linking members pivot thereabout to permit the intersections to become more proximate, and thus the floor panel must moved upwardly in concert with the lock bracket. However, the weight of a child supported on the floor panel effectively blocks upward movement of the floor panel, thus also blocking upward movement of the lock bracket and preventing collapse of the frame structure. However, in the absence of the weight of the child, the lock bracket may be urged upwardly with slight manual pressure, and the frame will collapse without hindrance as described in the Cheng patent referenced above.

In one embodiment of the invention, the lock bracket comprises a longitudinally extending member having a slot extending longitudinally therein and opening downwardly toward the floor on which the erected apparatus is supported. Each linking member includes a longitudinally extending web received in the slot and pinned therein. The web is disposed to impinge on one edge of the slot to limit rotation of the linking members substantially to a downwardly opening semicircular angle. The lock bracket may comprise a rectangular sleeve formed of a steel panel folded back on itself to define the slot therebetween.

DESCRIPTION OF THE PREFERRED EMBODIMENT

The invention generally comprises an improved frame construction for a collapsible play yard or playpen, and is specifically directed toward a safety device that prevents accidental collapse of the play yard or play pen whenever it is occupied by a baby or child.

Figure 1:
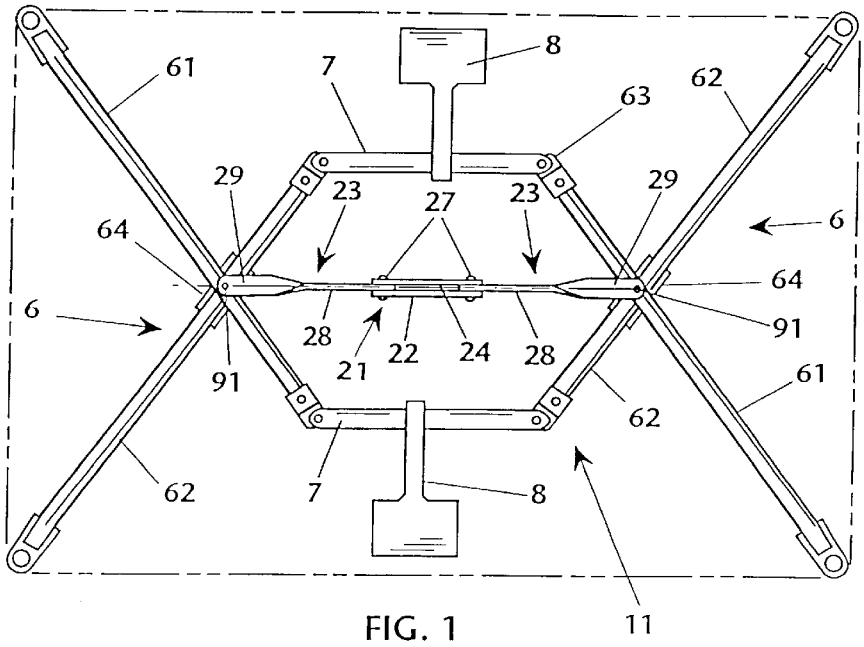
FIG. 1 is a plan view of an improved lower frame structure for a folding playpen, including the floor lock assembly of the present invention.
Figure 2:
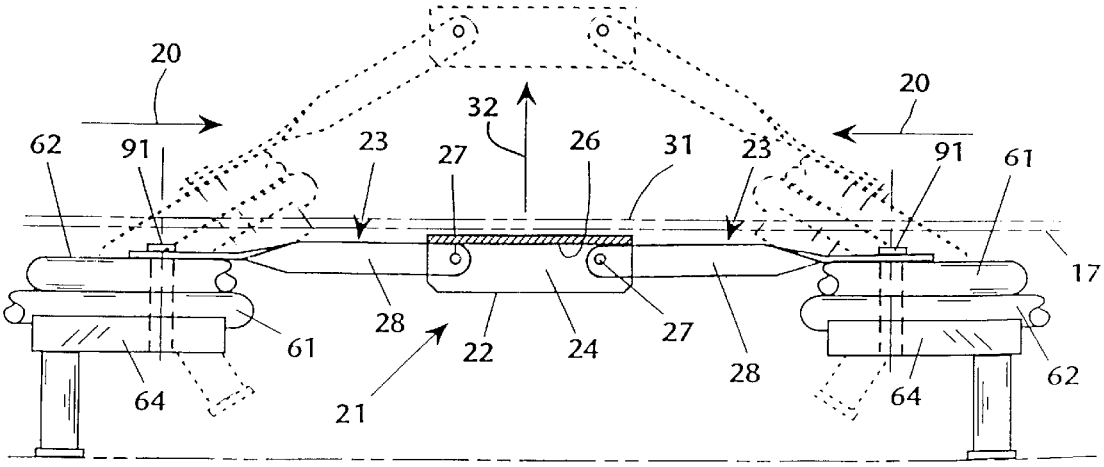
FIG. 2 is an enlarged partially cutaway side elevation of the floor lock assembly as depicted in FIG. 1.
Figure 3:
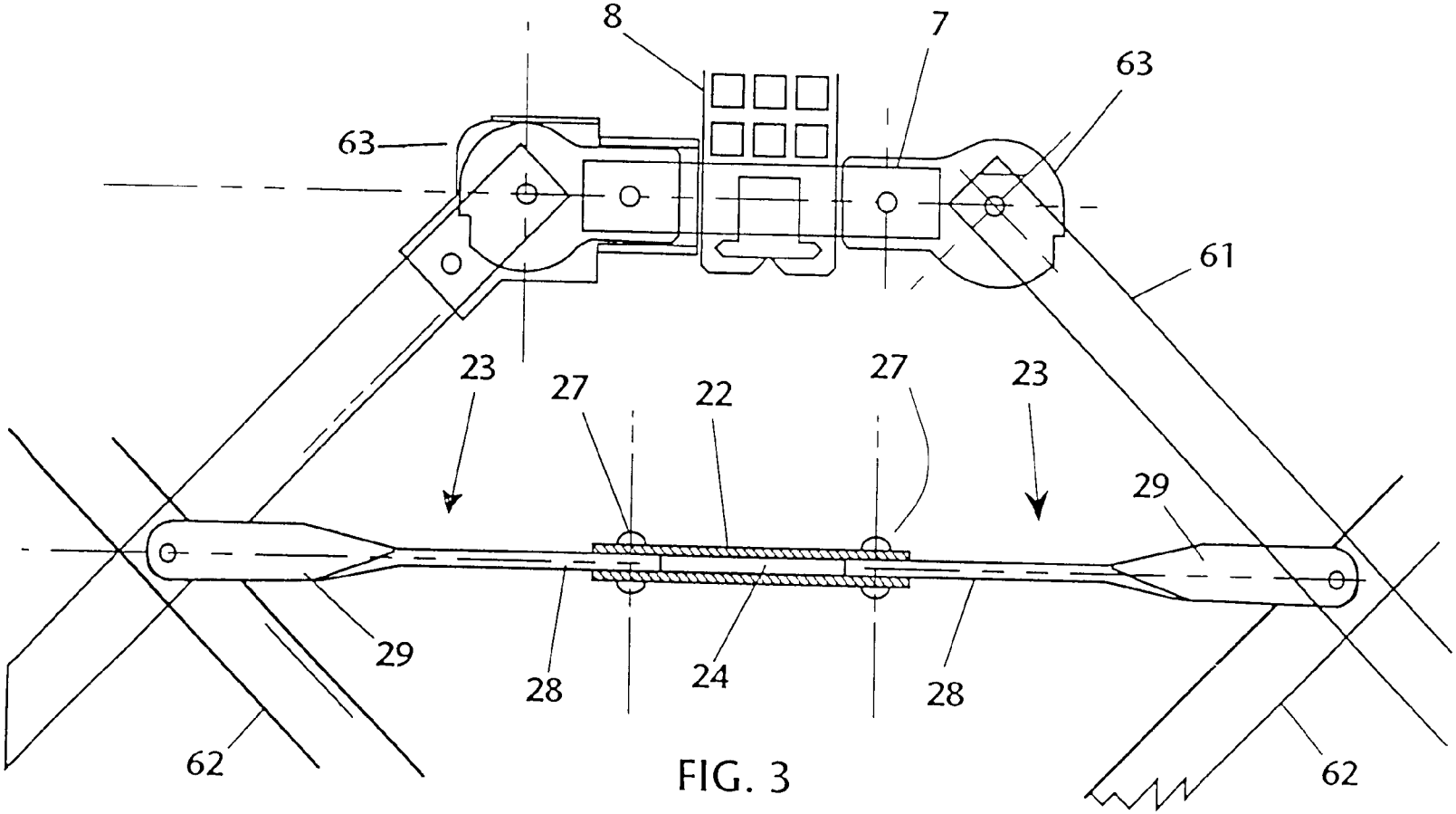
FIG. 3 is a plan view of the floor lock assembly of the present invention installed in a similar version of a lower frame structure for a folding playpen.

With regard to FIGS. 1–3, a typical playpen collapsible frame structure generally includes a lower frame assembly 11 comprised of a pair of parallel connecting rod units 7 pivotally joined to a pair of crossing rod assemblies 6, using the reference numerals and nomenclature of the Cheng patent. A pair of movable bases 8 extend from the connecting rod units 7 to broaden the support for the floor panel of the apparatus. Each crossing rod assembly 6 includes a straight rod 61 intersecting a curved rod 62, and a pivot pin or bolt 91 secures the two rods to a movable base 64 at the intersection.

During collapse of the lower frame assembly, the pivoting intersections formed by bolts 91 move toward each other as the crossing rods 61 and 62 pivot about their connections 63 to the connecting rods, as shown by arrows 20 in FIG. 2.

The present invention improves upon the lower frame structure of Cheng by providing a floor lock assembly 21 to prevent accidental collapse of the lower frame structure when the apparatus is erected and occupied by a child. The floor lock assembly 21 includes a lock bracket 22 and a pair of linking members 23 joined to the bracket 22. The lock bracket includes a longitudinally extending slot 24 that opens downwardly with respect to the floor surface on which the apparatus is supported, as shown in FIG. 2.

Each linking member includes a longitudinally extending web portion 28 extending into the slot 24 and secured therein by a pivot pin 27. The pins 27 are disposed so that the upper edge of each web portion 28 impinges on the closed upper side of the slot 24, thereby limiting rotation of each linking member to an axis coextensive with the upper side and preventing rotation of the linking members to slightly above horizontal, as shown in FIG. 2. That is, the linking members 23 may rotate about their respective pivots 27 only through the semicircular angle lying in the plane of the slot below the inside edge 26 thereof.

The outer end web portions 29 of the linking members 23 are disposed in a plane orthogonal to the plane of the web portions 28, and are secured to the respective crossing rods 61 and 62 and movable bases 64 by pivot pins or bolts 91. The maximum extended length of the linking members 23, wherein the linking members are longitudinally, horizontally opposed, as shown in FIG. 2, defines the maximum separation of the pivot pins 91, which occurs in the erected, deployed disposition of the lower frame structure. The floor panel 31 of the playpen apparatus is directly superjacent to the lower frame structure and the medial portion of the floor panel 31 rests on and is supported by the floor lock assembly 21.

The floor lock assembly 21 in the disposition shown in the Figures prevents movement of the pivot bolts 91 toward each other, and thus blocks collapse of the lower frame structure. The rigid linking members 23 cannot rotate upwardly with respect to the bracket 22, so that the bracket 22 cannot move downwardly past the position shown. Due to the slight overcenter arrangement of these components, the floor lock may be released only upon upward movement of the bracket 22 with respect to the floor supporting the movable bases 64. Such upward movement must be accompanied by like upward movement of the floor panel 31.

However, when a child occupies the play yard, the weight of the child is exerted on the lower frame structure and the floor lock assembly 21 itself, thus opposing the upward movement of the floor panel 31 that is necessary for collapse of the structure. Moreover, the weight of the floor panel 31 and occupant further enhances the overcenter relationship of the linking members 23 and lock bracket 22, thereby preventing initiation of collapse of the lower frame structure.

When there is no occupant in the play yard apparatus, the floor lock is released by applying slight upward force on the lock bracket 22, whereby the linking members 23 move past the overcenter position and the lock bracket 22 moves upwardly as the members 23 pivot downwardly in relation thereto, as shown in phantom line in FIG. 2.

A simple form of the lock bracket 22 may be fabricated by folding a panel of steel sheet or similar form-retaining, high strength material along a longitudinal line to define two web portions in closely spaced, parallel, confronting relationship, with the slot 24 defined between the two web portions. The fold line of the bracket defines the angular stop for the linking members 23.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

We claim:

1. In a collapsible frame structure for a playpen that includes a pair of parallel connecting rod units pivotally joined to a pair of crossing rod assemblies to support a floor panel, the improvement comprising:

floor lock assembly means connected between said pair of crossing rod assemblies for blocking proximate movement of portions of said pair of crossing rod assemblies during collapse of said frame structure;

said floor lock assembly means including a pair of linking members, said linking members including like outer ends and like inner ends;

means for connecting each of said outer ends of said linking members to one of the crossing rod assemblies in horizontally pivoting fashion;

a lock bracket including means for engaging the inner ends of said linking members in vertically pivoting fashion; and, means for releasably aligning said linking members and lock bracket in an overcenter relationship that blocks proximate movement of said portions of said crossing rod assemblies.

2. The improved collapsible frame structure of claim 1, wherein said means for releasably aligning includes means for defining a rotational limit axis extending generally parallel with the longitudinal axes of both said linking members, and means for blocking rotation of each of said linking members substantially beyond said limit axis.

3. The improved collapsible frame structure of claim 2, wherein said means for defining a rotational limit axis includes a slot extending longitudinally in said lock bracket, said first ends of said linking members received within said slot.

4. The improved collapsible frame structure of claim 3, wherein said slot includes an inner longitudinal edge extending substantially coextensive with said rotational limit axis and disposed to impinge on said first ends of said linking members when said linking members are disposed in said overcenter relationship.

5. The improved collapsible frame structure of claim 1, wherein said lock bracket extends along a longitudinal axis between said portions of said crossing rod assemblies, and said linking members extend generally coaxially with said longitudinal axis.

6. The improved collapsible frame structure of claim 1, wherein said lock bracket includes a slot extending longitudinally therein, said first ends of said linking members received within said slot.

7. The improved collapsible frame structure of claim 6, further including a rotational limit axis extending generally parallel to said longitudinal axis, said slot including an inner longitudinal edge extending substantially coextensive with said rotational limit axis and disposed to impinge on said first ends of said linking members when said linking members are disposed in said overcenter relationship.

8. The improved collapsible frame structure of claim 1, wherein said lock bracket is disposed subjacently of a medial portion of the floor panel and impinging thereon in a weight-bearing relationship.

9. The improved collapsible frame structure of claim 8, wherein said lock bracket is variably positioned and movable from a first, locked position in which it is disposed in said overcenter relationship in weight-bearing relationship to the floor panel, to a second, released position in which said lock bracket is translated upwardly with respect to crossing rod assemblies and said linking members are rotated downwardly with respect to said lock bracket.

* * * * *